United States Patent [19]

Lunn

[11] Patent Number: 4,700,936

[45] Date of Patent: Oct. 20, 1987

[54] CLAMP MECHANISM

[75] Inventor: Garfield R. Lunn, Amherstburg, Canada

[73] Assignee: Lamb Technicon Corp., Warren, Mich.

[21] Appl. No.: 900,437

[22] Filed: Aug. 26, 1986

[51] Int. Cl.[4] ..... B25B 1/06

[52] U.S. Cl. ..... 269/226; 269/238

[58] Field of Search ..... 269/94, 224–226, 269/238, 222

[56] References Cited

U.S. PATENT DOCUMENTS 3,063,708 11/1962 Wollenhaupt ..... 269/226 X 3,188,077 6/1965 Olson ..... 269/226

3,704,879 12/1972 Nishikawa ..... 269/224 X

*Primary Examiner*—Frederick R. Schmidt

*Assistant Examiner*—Judy J. Hartman

*Attorney, Agent, or Firm*—Barnes, Kisselle, Raisch, Choate, Whittemore & Hulbert

[57] ABSTRACT

A workpiece clamping device with a movable clamp member actuated by a jack screw driven by a reversible electric motor through a worm meshing with a gear connected to the jack screw. To yieldably bias the clamp member into engagement with the workpiece, a spring is compressed by axial movement of the worm caused by rotating it after the clamp member is forced into engagement with the workpiece by the jack screw.

7 Claims, 2 Drawing Figures

CLAMP MECHANISM

FIELD OF THE INVENTION

This invention relates to a clamp mechanism for workpieces and the like and more particularly to a motor driven biased clamp mechanism.

BACKGROUND OF THE INVENTION

Previously, many clamping devices have been developed in which a workpiece or the like is releasably secured between a fixed member and a movable member powered by a hydraulic or pneumatic cylinder. When the workpiece is clamped in the device, the cylinder continuously yieldably urges the members into engagement with the workpiece. This permits additional displacement of the movable member when needed without allowing the workpiece to become loose or be subjected to a substantially decreased clamping force. This need for additional displacement after initial clamping of the workpiece can be caused by many things, including expansion and contraction of the workpiece and members of the clamping device due to changes in temperature. The continuous bias provided by the cylinder also compensates for tolerances and variations in dimensions of a series of successive workpieces secured by the clamping device.

In use, hydraulic and pneumatic clamping devices utilize relatively large amounts of energy, must be supplied with fluid under pressure continuously even though they may not be used at any given time, produce considerable heat, and usually contaminate the environment in which they operate with oil which collects much dirt. In operation, these devices and particularly pneumatic devices, are objectionably noisy.

In recent years, laws and regulations have been promulgated establishing standards for maximum noise and contamination levels. It is most difficult, and in many instances impractical, if not imposible, to construct hydraulic and pneumatic clamping devices which comply therewith.

SUMMARY OF THE INVENTION

A workpiece clamping device having a movable clamping member yieldably biased in its clamping position and driven by a mechanical mechanism powered by a reversible motor. Preferably, the clamping member is moved by a threaded jack screw rotated by a gear and a worm driven by a reversible electric motor. The clamp member is yieldably biased by a spring which is compressed preferably by axial movement of the worm after the clamp member initially bears on the workpiece.

Objects, features and advantages of this invention are to provide a clamp mechanism which is mechanically actuated and yieldably biased in its clamped position when bearing on a workpiece, energy efficient, quiet, non-polluting of the environment in which it operates, readily complies with noise and pollution standards, rugged, durable, of simplified and economical design, manufacture and assembly and in service requires little maintenance and has a long useful life.

BRIEF DESCRIPTION OF THE DRAWING

These and other objects, features and advantages of this invention will be apparent from the following detailed description, appended claims and accompanying drawing in which

DETAILED DESCRIPTION

Figure 1:
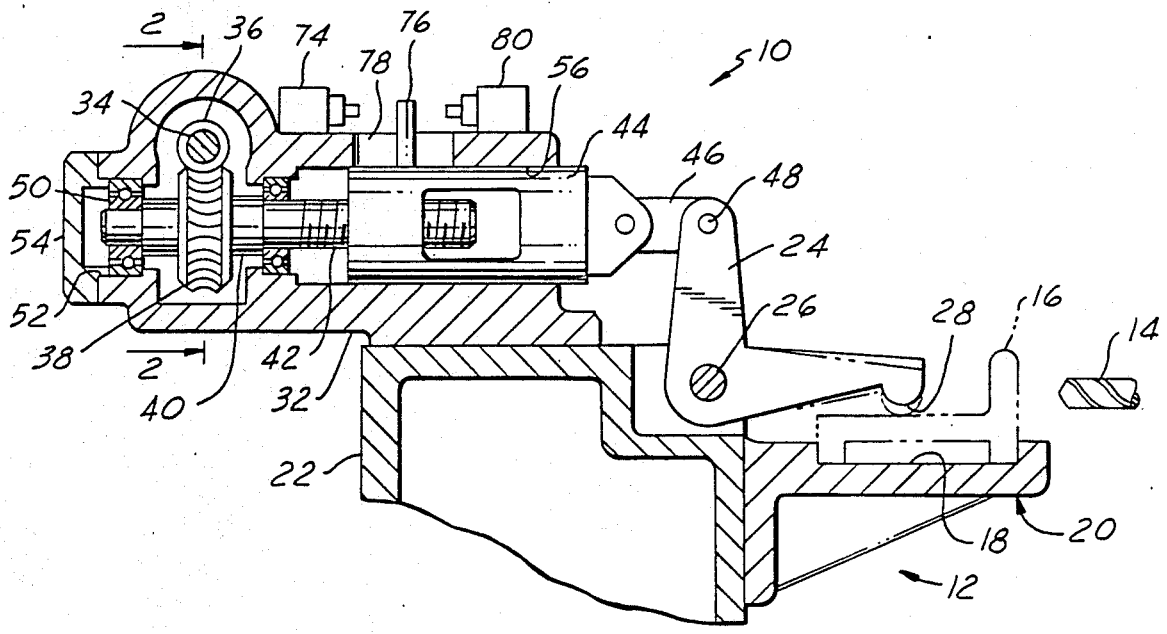
FIG. 1 is a side view in section of a clamp device embodying this invention mounted on the base of a machine tool to secure a workpiece for drilling a hole therein.
Figure 2:
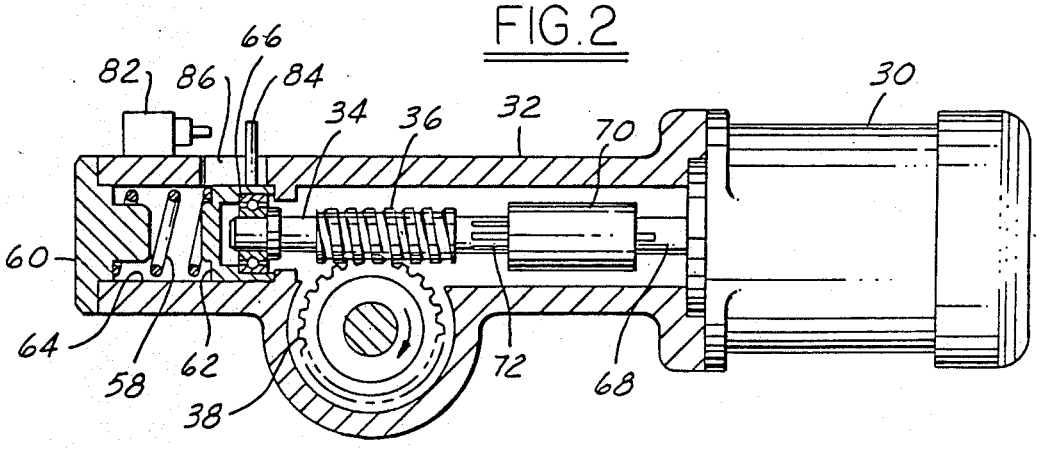
FIG. 2 is a sectional view taken generally on line 2—2 of FIG. 1.

Referring in more detail to the drawing, FIGS. 1 and 2 illustrate a clamp device 10 embodying this invention mounted on a machine tool 12 having a drill 14 for boring a hole in a workpiece 16. This workpiece is received and located in a slot 18 in a support 20 secured to a base 22 of the machine tool. The workpiece is releasably clamped to the support by a bell crank member 24 pivotally mounted by a pin 26 on the base and having a pad 28 for engaging the workpiece.

The bell crank is powered by a reversible motor 30 mounted on a housing 32 secured to the base. Preferably, the motor 30 is an electric motor with a brake. The motor is operably connected to the bell crank through a drive shaft 34 with a worm 36 engaging a mating worm gear 38 keyed to a jack shaft 40 with a threaded screw portion 42 engaging a plunger nut 44 with mating threads. The plunger is connected to the bellcrank by a link 46 and pivot pins 48. The jack shaft is journalled for rotation by a pair of ball bearings 50 carried by the housing and received in counterbores 52. A cover 54 is secured by cap screws (not shown) to the housing and entraps one of the bearings 50 in its counterbore. The plunger is slidably received in a cylindrical bore 56 in the housing.

When the bell crank bears on the workpiece, it is firmly urged into engagement therewith by a spring 58 which is compressed by axial displacement of the drive shaft 34 by the motor. The force produced by the compressed spring is transmitted to the bell crank through the drive shaft 34, worm 36, worm gear 38, jack shaft 40, plunger nut 44 and link 46. This force is multiplied by the lever arm of the pitch radius of the worm gear 38 and the wedge of the threads 42 of jack shaft and plunger nut 46. Great resistance to the forces tending to unclamp the workpiece is also provided by this wedge. If desired, a locking arrangement preventing unclamping of the workpiece by these forces can be provided by selecting an appropriate pitch and diameter for the threads of the jack shaft screw and plunger nut.

At one end the spring 58 bears on a cover 60 secured to the housing by cap screws (not shown) and at the other end bears on a retainer cup 62 slidably received in a bore 64 in the housing. One end of the drive shaft is journalled for rotation by a bearing 66 carried by the cup 62. The other end of the drive shaft is coupled to an output shaft 68 of the motor 20 for rotation therewith and axial movement relative thereto by a coupling 70. The coupling is keyed to the output shaft and has internal splines complimentary to and slidably engaged with external splines 72 on the drive shaft.

Left hand or right hand threads are selected for the worm and the jack shaft screw so that after the worm is rotated to advance the bell crank to its clamped position, further rotation of the worm in the same direction will advance the worm and drive shaft axially to compress the spring. For example, if the worm has a right hand thread and the jack screw has a left hand thread, when the worm is rotated clockwise (as viewed in FIG.

1), the jack shaft screw will be rotated clockwise (as viewed in FIG. 2) to advance the bell crank to the clamped position, and thereafter further rotation of the worm in the same direction will advance the worm and drive shaft to the left (as viewed in FIG. 2) to compress the spring.

The clamp mechanism can be cycled and controlled by conventional electric or electronic control circuitry. To provide an indication that the bell crank has been moved sufficiently to fully release or unclamp the workpiece, a limit switch 74 is tripped to change state by engagement by a pin 76 carried by the plunger 44 and extending through an elongate slot 78 in the housing. To provide an indication that a workpiece is not present when the bell crank has been rotated to and beyond its clamping position, a limit switch 80 is tripped to change state by engagement by the pin 76. To provide an indication that the spring has been compressed by movement of the worm and driven shaft to the left (as viewed in FIG. 2), a limit switch 82 is tripped by a pin 84 carried by the bearing cup and extending through an elongate slot 86 in the housing. Rotation of the plunger nut 44 and the retainer cup 62 is also prevented by their associated pin and slot.

Normally, before the clamp device begins an operating cycle, the electric motor 30 is turned off and the bell crank 24 is in the unclamped position with the plunger nut 44 retracted sufficiently so that the limit switch 74 is tripped by the pin 76 to indicate the mechanism is in the fully unclamped position. A workpiece 16 is placed and located on the support 20 so that it underlies the pad 28 of the bell crank 24, as shown in FIG. 1. To advance the bell crank to clamp the workpiece on the support, the electric motor 30 is energized to rotate the worm 36 and thus the jack shaft 40 clockwise (as viewed in FIGS. 1 and 2 respectively). This rotation of the jack shaft advances the plunger nut 44 (to the right as viewed in FIG. 1) to rotate the bellcrank so its pad 28 bears on the workpiece to clamp it on the support. When the bell crank clamps the workpiece the gear 38 stops rotating and as the worm 36 continues to rotate, it advances the drive shaft 34 generally axially (to the left as viewed in FIG. 2) to yieldably bias the bell crank in its clamped position by compressing the spring 58 until the pin 84 trips the limit switch 82 which causes the motor 30 to be turned off. Thereafter, even if the workpiece expands or contracts, it continues to be clamped by the force produced by the compressed spring, which is transmitted to the bell crank through the retainer cup 62, drive shaft 34, worm 36, worm gear 38, jack shaft 40, plunger nut 44 and link 46.

To unclamp the workpiece, the motor is energized in the opposite direction to rotate the worm 36 and jack shaft 40 counterclockwise, as viewed in FIGS. 1 and 2 respectively. This moves the drive shaft 34 to the right, as viewed in FIG. 2, to relieve the spring bias force on the bell crank and then retracts the plunger nut 44 to thereby unclamp the workpiece. When the bell crank is moved to its fully unclamped position, the pin 76 trips the limit switch 74 which causes the motor to be turned off, thereby completing the cycle of the clamp device.

In the event there is no workpiece underlying the bell crank when it is advanced towards its clamping position, the pin 76 will trip the limit switch 80 to cause the motor to be turned off. If desired, through appropriate control circuitry, this limit switch can also cause the motor to reverse so that the device is returned to its fully unclamped position.

I claim:

1. A device for clamping a workpiece comprising, a housing, a jack shaft carried by said housing, a nut received on a threaded portion of said jack shaft and having threads mating therewith, a worm gear connected to one of said jack shaft and nut for rotating it relative to the other of said jack shaft and nut, bearing means carried by said housing and mounting said one of said jack shaft and nut for rotation and without any substantial axial movement relative to said housing, a clamp member operably connected to the other said jack shaft and nut and constructed and arranged to move in response to rotation of said worm gear in one direction to a clamped position wherein it bears on the workpiece and to move in response to rotation of said worm gear in the opposite direction to an unclamped position wherein it is disengaged and spaced from the workpiece, a drive shaft carried by said housing for rotation on and movement along an axis extending generally transverse to the axis of rotation of said worm gear, a worm connected to said drive shaft and meshing with said worm gear, a reversible electric motor having an output shaft, a coupling connecting said output shaft with said drive shaft for rotation therewith and construed and arranged to permit said drive shaft to move axially relative to said housing, and a spring carried by said housing, operably connected with said drive shaft and constructed and arranged to bias through said drive shaft, worm, worm gear, jack shaft and nut said clamp member into engagement with the workpiece at least when the drive shaft is rotated by said motor in the same direction sufficiently to axially displace the drive shaft after the worm gear has been rotated sufficiently to advance the clamp member to its clamping position, whereby the clamp member is biased into engagement with the workpiece.

2. The device of claim 1 which also comprises a first sensor constructed and arranged to produce an electric signal indicating said drive shaft is generally axially advanced to bias the clamp member into engagement with the workpiece.

3. The device of claim 2 which also comprises a second sensor constructed and arranged to provide an electric signal indicating said clamp member is in its unclamped position.

4. The device of claim 2 which also comprises a second sensor constructed and arranged to provide an electric signal indicating said clamp member has been advanced beyond its clamped position.

5. The device of claim 2 which also comprises a reversible electric motor with an output shaft operably connected with said drive shaft and wherein the signal of said first sensor is utilized to turn off said motor.

6. The device of claim 3 which also comprises a reversible electric motor with an output shaft operably connected with said drive shaft and wherein the signal from said first sensor is utilized to turn off said motor and the signal from said second sensor is utilized to turn off said motor.

7. The device of claim 4 which also comprises a reversible electric motor with an output shaft operably connected with said drive shaft and wherein the signal from said first sensor is utilized to turn off said motor and the signal from said second sensor is utilized to turn off said motor.

* * * * *